US007905093B2

(12) United States Patent
Li et al.

(10) Patent No.: US 7,905,093 B2
(45) Date of Patent: Mar. 15, 2011

(54) APPARATUS TO FACILITATE DECREASING COMBUSTOR ACOUSTICS

(75) Inventors: Shui-Chi Li, West Chester, OH (US); Michael Louis Vermeersch, Hamilton, OH (US); Zhong-Tao Dai, West Chester, OH (US); Timothy James Held, Blanchester, OH (US); Mark Anthony Mueller, West Chester, OH (US)

(73) Assignee: General Electric Company, Schenectady, NY (US)

( * ) Notice: Subject to any disclaimer, the term of this patent is extended or adjusted under 35 U.S.C. 154(b) by 1027 days.

(21) Appl. No.: 11/689,759

(22) Filed: Mar. 22, 2007

(65) Prior Publication Data

US 2008/0229753 A1 Sep. 25, 2008

(51) Int. Cl.
*F02C 1/00* (2006.01)

(52) U.S. Cl. ..... 60/746; 60/748

(58) Field of Classification Search ..... 60/737, 60/738, 740, 746, 747, 748
See application file for complete search history.

(56) References Cited

U.S. PATENT DOCUMENTS 6,418,726 B1 * 7/2002 Foust et al. ..... 60/776
6,871,501 B2 * 3/2005 Bibler et al. ..... 60/772
7,007,479 B2 3/2006 Held et al.
7,059,135 B2 6/2006 Held et al.
2005/0103021 A1 5/2005 Held et al.
2006/0096296 A1 5/2006 Held et al.
2006/0123792 A1 6/2006 Xu et al.
2006/0248898 A1 11/2006 Buelow
2007/0039329 A1 2/2007 Abreu et al.
2008/0078181 A1 * 4/2008 Mueller et al. ..... 60/776

* cited by examiner

*Primary Examiner* — Louis Casaregola

(74) *Attorney, Agent, or Firm* — William Scott Andes, Esq.; Armstrong Teasdale LLP

(57) ABSTRACT

A method for operating a gas turbine engine including a compressor and a combustor is provided. The method comprises channeling between about 0% to about 8% of the total airflow discharged from a compressor towards a pilot swirler coupled within the burner, wherein the burner includes a main swirler and an annular centerbody extending between the pilot and main swirlers, injecting a portion of the total fuel flow supplied to the burner through a plurality of apertures defined in a hollow pilot centerbody coupled within the pilot swirler, channeling the remaining airflow discharged from the compressor towards the main swirler, and injecting the remaining fuel flow supplied to the burner through at least one main swirler vane coupled within the main swirler, such that the portion of fuel is pre-mixed with a portion of the total airflow.

12 Claims, 3 Drawing Sheets

APPARATUS TO FACILITATE DECREASING COMBUSTOR ACOUSTICS

BACKGROUND OF THE INVENTION

This invention relates generally to combustors and more particularly, to methods and apparatus to facilitate decreasing combustor acoustics.

During the combustion of natural gas, pollutants such as, but not limited to, carbon monoxide ("CO"), unburned hydrocarbons ("UHC"), and nitrogen oxides ("NOx") may be formed and emitted into an ambient atmosphere. At least some known emission sources include devices such as, but not limited to, gas turbine engines and other combustion systems. Because of stringent emission control standards, it is desirable to control emissions of such pollutants by attempting to suppress the formation of such emissions.

At least some known combustion systems implement combustion modification control technologies such as, but not limited to, Dry-Low-Emissions ("DLE") combustors and other lean pre-mixed combustors to facilitate reducing emissions of pollutants from the combustion system by using pre-mixed fuel injection. For example, at least some known DLE combustors attempt to reduce the formation of pollutants by lowering a combustor flame temperature using lean fuel-air mixtures and/or pre-mixed combustion. However, at least some known DLE combustors experience combustion acoustics, or combustion instabilities, that can limit the overall operability and performance of a combustion system including a known DLE combustor. Over time, the magnitude of the combustion instabilities may increase to a level that may cause damage to the combustion system. As a result, operability, emissions, maintenance cost, and useful life of combustor components may be negatively affected.

BRIEF DESCRIPTION OF THE INVENTION

In one aspect, a method for operating a gas turbine engine including a compressor and a combustor is provided. The method comprises channeling between about 0% to about 8% of the total airflow discharged from a compressor towards a pilot swirler coupled within the burner, wherein the burner includes a main swirler and an annular centerbody extending between the pilot and main swirlers, injecting a portion of the total fuel flow supplied to the burner through a plurality of apertures defined in a hollow pilot centerbody coupled within the pilot swirler, channeling the remaining airflow discharged from the compressor towards the main swirler, and injecting the remaining fuel flow supplied to the burner through at least one main swirler vane coupled within the main swirler, such that the portion of fuel is pre-mixed with a portion of the total airflow.

In another aspect, a combustor for use in a gas turbine engine comprising is provided. The combustor comprises a main swirler, and a pilot swirler coupled to the main swirler. The pilot swirler comprises a hollow pilot centerbody, an inner swirler, an outer swirler, and an annular splitter extending between the inner and outer swirlers such that a pilot combustion zone is defined within the annular splitter. The hollow pilot centerbody comprises a plurality of apertures extending therethrough. The pilot swirler is operable with only between about 0% and about 8% of the total airflow entering the combustor.

In a further aspect, a gas turbine engine comprising a combustor and a compressor is provided. The gas turbine engine comprises a main swirler and a pilot swirler coupled to the main swirler, the pilot swirler comprising a hollow pilot centerbody, an inner swirler, an outer swirler, and an annular splitter extending between the inner and outer swirlers such that a pilot combustion zone is defined within the annular splitter, the hollow pilot centerbody comprising a plurality of apertures extending therethrough, the pilot swirler operable with only between about 0% and about 8% of the total airflow entering the combustor.

DETAILED DESCRIPTION OF THE INVENTION

It should be appreciated that the term "forward" is used throughout this application to refer to directions and positions located axially upstream towards a fuel/air intake side of a combustion system, for the ease of understanding. It should also be appreciated that the term "aft" is used throughout this application to refer to directions and positions located axially downstream toward an exit plane of a main swirler, for the ease of understanding.

Figure 1:
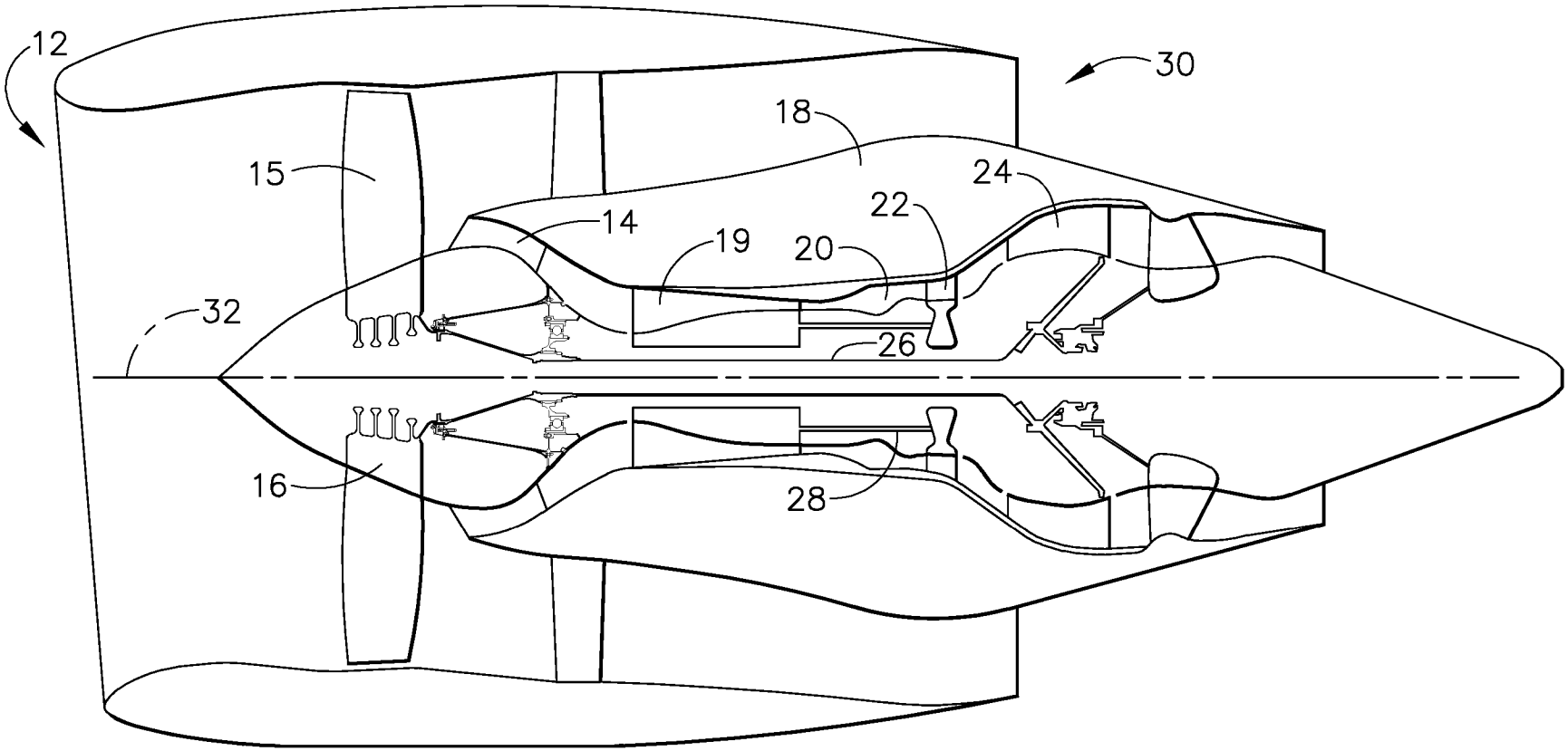
FIG. 1 is a schematic illustration of an exemplary gas turbine engine including a combustor.

FIG. 1 is a schematic illustration of an exemplary gas turbine engine 10 including an air intake side 12, a fan assembly 14, a core engine 18, a high pressure turbine 22, a low pressure turbine 24, and an exhaust side 30. Fan assembly 14 includes an array of fan blades 15 extending radially outward from a rotor disc 16. Core engine 18 includes a high pressure compressor 19 and a combustor 20. Fan assembly 14 and low pressure turbine 24 are coupled by a first rotor shaft 26, and high pressure compressor 19 and high pressure turbine 22 are coupled by a second rotor shaft 28 such that fan assembly 14, high pressure compressor 19, high pressure turbine 22, and low pressure turbine 24 are in serial flow communication and co-axially aligned with respect to a central rotational axis 32 of gas turbine engine 10. In one exemplary embodiment, gas turbine engine 10 is a LM6000 engine commercially available from General Electric Company, Cincinnati, Ohio.

During operation, air enters through air intake side 12 and flows through fan assembly 14 to high pressure compressor 19. Compressed air is delivered to combustor 20. Airflow from combustor 20 drives high pressure turbine 22 and low pressure turbine 24 prior to exiting gas turbine engine 10 through exhaust side 30.

Figure 2:
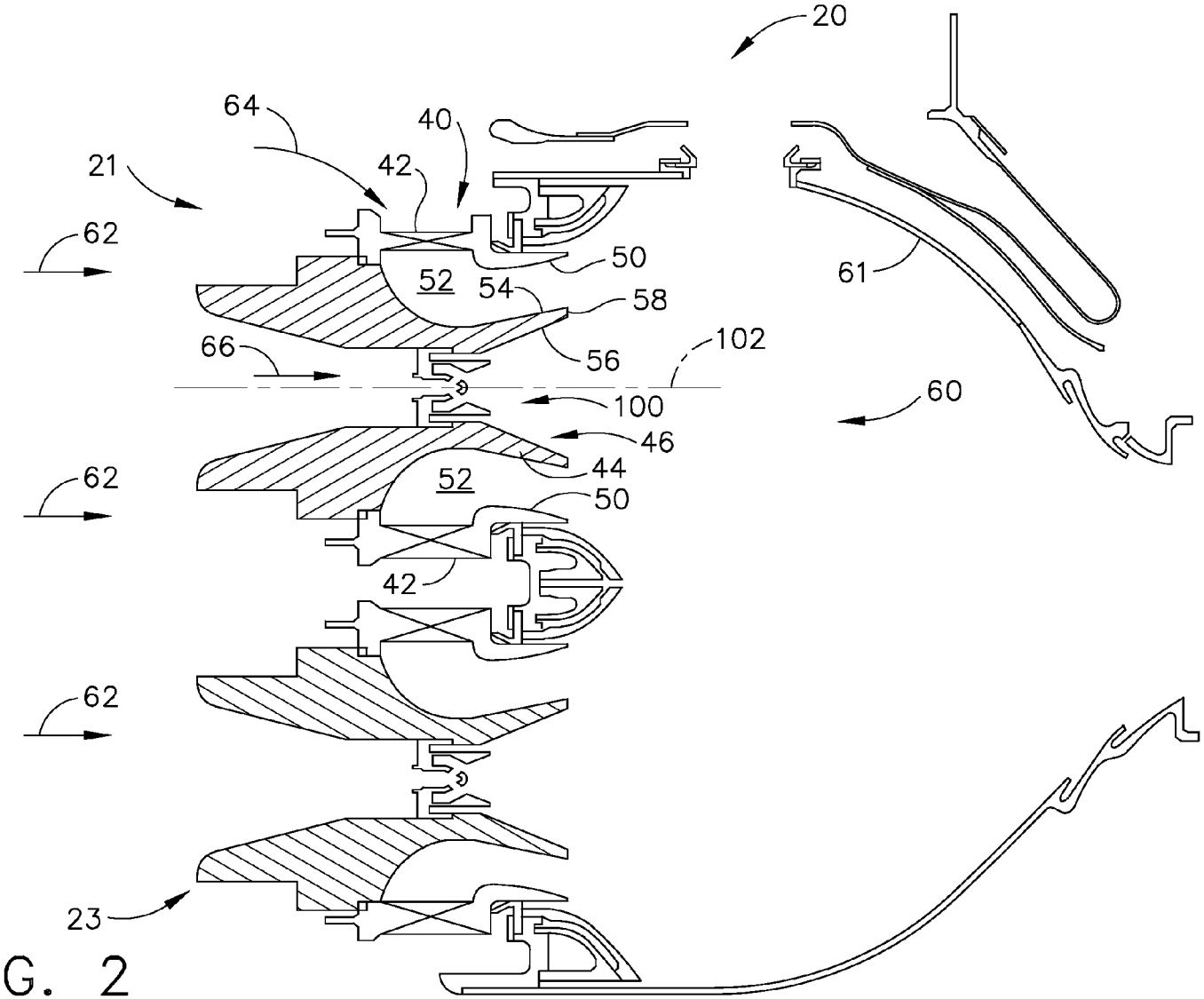
FIG. 2 is a schematic cross-sectional view of an exemplary combustor including two exemplary burners that each include an exemplary pilot swirler assembly that may be used with the gas turbine engine shown in FIG. 1.

FIG. 2 is a schematic cross-sectional view of exemplary combustor 20 that may be used with a gas turbine engine, such as gas turbine engine 10 (shown in FIG. 1). In the exemplary embodiment, combustor 20 includes an outer burner 21 and an inner burner 23. Each burner 21 and 23 includes a pilot swirler assembly 100 and a main swirler assembly 40. Generally, in the exemplary embodiment, combustor 20 includes main swirler assembly 40, pilot swirler 100, and an annular centerbody 44 extending therebetween. Specifically, in the exemplary embodiment, annular centerbody 44 is positioned radially outward from pilot swirler 100 and extends circumferentially about pilot swirler 100. Moreover, annular centerbody 44 includes a radially inner surface 56 and a radially outer surface 54 that are connected at a trailing end 58. More specifically, annular centerbody 44 is substantially co-axially aligned with a central axis 102 of pilot swirler 100 and defines a centerbody cavity 46.

In the exemplary embodiment, main swirler 40 includes an annular main swirler housing 50 that is spaced radially outward from pilot swirler 100 and centerbody 44, such that an annular main swirler cavity 52 is defined between housing 50 and radially outer surface 54 of centerbody 44. In the exemplary embodiment, main swirler 40 also includes a plurality of main swirler vanes 42 that extends between annular centerbody 44 and housing 50. Vanes 42 are spaced circumferentially within main swirler 40. Moreover, in the exemplary embodiment, main swirler 40 is substantially co-axially aligned with respect to central axis 102 and extends circumferentially about pilot swirler 100. A main swirler combustion zone 60 is defined downstream from main swirler 40 and pilot swirler 100. Main swirler combustion zone 60 is defined by an annular combustor liner 61.

Figure 3:
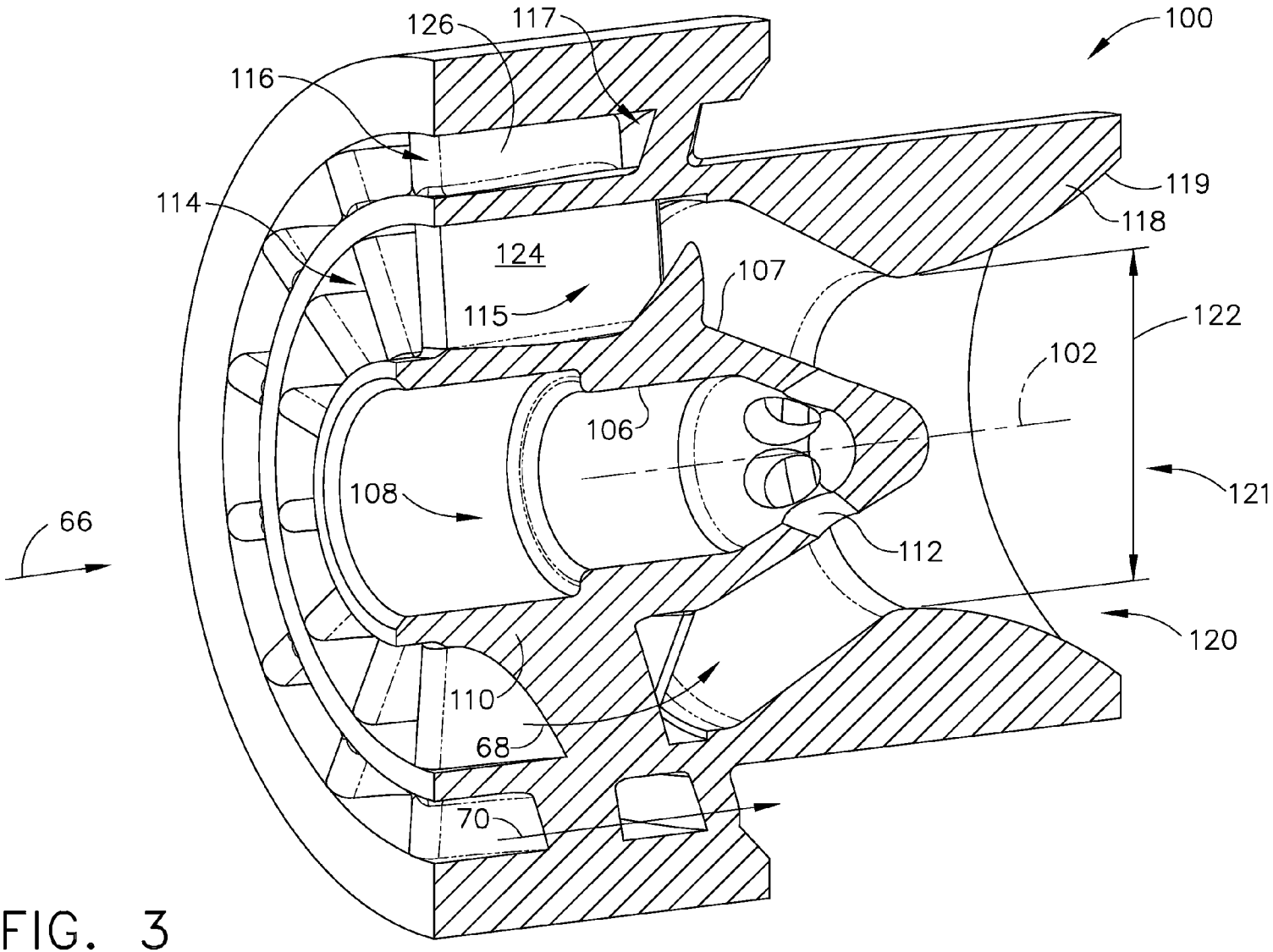
FIG. 3 is a perspective view of an exemplary pilot swirler that may be used with the burner shown in FIG. 2.

FIG. 3 is a perspective view of an exemplary pilot swirler assembly 100 that may be used with combustor 20 (shown in FIG. 2). In the exemplary embodiment, pilot swirler 100 includes a pilot centerbody 110, a radially inner pilot swirler 114, a radially outer pilot swirler 116, and an annular splitter 118 extending between inner and outer pilot swirlers 114 and 116, respectively. Specifically, in the exemplary embodiment, splitter 118 is positioned radially outward from pilot centerbody 110 and extends circumferentially about pilot centerbody 110. Splitter 118 extends axially downstream from inner and outer swirlers 114 and 116, respectively, and in the exemplary embodiment, splitter 118 is substantially co-axially aligned with axis 102. A pilot splitter cavity 120 is defined by a radially inner surface 119 of splitter 118. Moreover, in the exemplary embodiment, cavity 120 includes a venturi throat 122 that is defined by radially inner surface 119 of splitter 118. A pilot combustion zone 121 is positioned downstream of splitter cavity 120.

Further, in the exemplary embodiment, pilot centerbody 110 is hollow and defines a pilot centerbody chamber 108 therein. Chamber 108 is substantially centered within centerbody 110, and includes a plurality of apertures 112 that couple chamber 108 in flow communication with splitter cavity 120. Each aperture 112 extends from a radially inner surface 106 of centerbody 110 to a radially outer surface 107 of centerbody 110. More specifically, in the exemplary embodiment, pilot centerbody 110 includes five apertures 112 spaced circumferentially about centerbody chamber 108. In another embodiment, pilot centerbody 110 may include more or less than five apertures 112.

In the exemplary embodiment, pilot inner swirler 114 includes an inner swirler cavity 115 that is defined by splitter 118 and by pilot centerbody 110. Cavity 115 extends circumferentially about pilot centerbody 110. A plurality of swirler vanes 124 extend generally radially across inner swirler cavity 115. Vanes 124 are spaced circumferentially about pilot centerbody 110.

Outer swirler 116 includes an outer swirler cavity 117 that is defined by splitter 118 and by radially inner surface 56 of annular centerbody 44. Cavity 117 extends circumferentially about splitter 118. A plurality of swirler vanes 126 extend substantially radially across outer swirler cavity 117. Vanes 126 are spaced circumferentially about splitter 118.

Each pilot swirler 100 within combustor 20 is sized and oriented to receive a pilot airflow 66 channeled downstream from a compressor, such as compressor 19 (shown in FIG. 1), for example. In the exemplary embodiment, each pilot swirler 100 receives between about 0% and about 8% of the total airflow 62 (shown in FIG. 2) entering combustor 20. More preferably, each pilot swirler 100 receives between about 2% and about 7% of total airflow 62 entering combustor 20. Most preferably, pilot swirler 100 receives about 5% of total airflow 62 entering combustor 20. In the exemplary embodiment, a remaining main swirler airflow 64 (shown in FIG. 2) of total airflow 62, is channeled towards main swirler 40. An airflow ratio of main swirler 40 to pilot swirler 100 is about 20. As a result, the exemplary embodiment is a super small non-premixed pilot.

In the exemplary embodiment, pilot swirler 100 is configured to discharge a fuel flow (not shown) into splitter cavity 120 that is between about 0% and about 5% of a total fuel flow (not shown) supplied to combustor 20. More preferably, pilot swirler 100 is configured to discharge the fuel flow into splitter cavity 120 that is between about 1% and about 4% of the total fuel flow supplied to combustor 20. Most preferably, pilot swirler 100 is configured to discharge about 2% of the total fuel flow supplied to combustor 20 into splitter cavity 120.

During operation of combustor 20, the total airflow 62 is channeled to combustor 20 from compressor 19. In the exemplary embodiment, the main swirler airflow 64 is channeled towards main swirler 40 and pilot airflow 66 is delivered to pilot swirler 100. Main airflow 64 enters main swirler 40 and mixes with main fuel (not shown) supplied to main swirler 40 via a main swirler manifold (not shown). Specifically, in the exemplary embodiment, fuel and air are pre-mixed in main swirler 40 before the resulting pre-mixed fuel-air mixture is channeled through main swirler cavity 52 into main swirler combustion zone 60. More specifically, main swirler 40 facilitates providing a lean, well-dispersed fuel-air mixture to combustor 20 that facilitates reducing NOx and CO emissions from engine 10. The fuel-air mixture is supplied to main swirler combustion zone 60 via main swirler cavity 52 wherein combustion occurs.

Further, in the exemplary embodiment, pilot airflow 66 is channeled towards pilot swirler 100. Pilot airflow 66 is separated into an inner pilot swirler cavity flow 68 and an outer pilot swirler cavity flow 70. Outer flow 70 is channeled through outer swirler 116 and is channeled to main swirler combustion zone 60 past inner surface 56 of annular centerbody 44. In the exemplary embodiment, outer flow 70 is not mixed with fuel before being channeled towards main swirler combustion zone 60. Moreover, in the exemplary embodiment, outer flow 70 facilitates cooling annular centerbody 44. Inner flow 68 is channeled through inner swirler 114 and mixes in splitter cavity 120 with pilot fuel injected from chamber 108 via apertures 112 to form a non-pre-mixed pilot fuel-air mixture. The resulting non-pre-mixed pilot fuel-air mixture is ignited to generate a pilot flame which extends adjacent to inner surface 119 of splitter 118 and extends downstream from pilot swirler 100. As such, the pilot flame is substantially sheltered from outer swirler cavity flow 70. Moreover, centerbody 44 facilitates sheltering outer flow 70 and the pilot flame from the main fuel-air mixture discharged through main swirler cavity 52.

Combustor 20 has naturally occurring acoustic frequencies that may be experienced during operation of engine 10. Specifically, when operated under lean conditions, high combustion acoustics, or combustion instabilities, can be produced in combustor 20. High combustion instability magnitudes may produce dangerous levels of vibrations. In the exemplary embodiment, as described in more detail below, pilot swirler 100 facilitates suppressing combustion acoustics during combustion of the lean fuel-air mixture while maintaining low NOx and CO emissions.

Pilot swirler 100 facilitates suppressing combustion instabilities using the pilot flame generated by the pilot fuel-air mixture. In the absence of the pilot flame, the main swirler flame is unstable. During operation of pilot swirler 100, the pilot flame generates a hot gaseous flow that extends downstream from splitter cavity 120 and pilot swirler combustion zone 121. The flow mixes with the main swirler flame at trailing end 58 where combustion instabilities may occur. The pilot flame, extending from pilot swirler combustion zone 121, facilitates stabilizing and positioning the main swirler flame around trailing end 58. As a result, the stabilized main swirler flame positioned at trailing end 58 suppresses the overall combustion instabilities of combustor 20.

In the exemplary embodiment, testing has shown that when pilot swirler 100 receives about 5% of total airflow 62, combustion instabilities were suppressed by using fuel flows between about 0% and about 5% of the total fuel flow to combustor 20. Moreover, in the exemplary embodiment, testing has shown that use of pilot swirler 100 with fuel flows between about 0% and about 5% did not substantially increase the emissions of NOx and CO. For example, in a first exemplary pilot fuel test, about 0% of the fuel was discharged by pilot swirler 100. In the first test, the NOx and CO emissions generated were about 11 parts per million ("ppm") and about 10 ppm, respectively. In a second exemplary pilot fuel test, about 2% of the total fuel flow was discharged by pilot swirler 100. The NOx emissions, in the second exemplary test, increased between about 1 ppm to about 2 ppm, however, the CO emissions did not increase.

As described above, in the exemplary embodiment, pilot swirler 100 facilitates limiting emissions of NOx and CO levels and controlling combustion instabilities in combustor 20. Specifically, main swirler 40 facilitates providing a lean fuel-air mixture by pre-mixing fuel with main swirler airflow 64. The resulting main swirler flame has a lower temperature than a non-lean flame and facilitates reducing an amount of NOx emissions produced during combustion. The low flame temperature, however, facilitates increasing combustion instabilities of combustor 20. In the exemplary embodiment, pilot swirler 100 facilitates suppressing the combustion instabilities of combustor 20 by providing a non-lean and non-premixed fuel-air mixture using about 0% to about 5% of the total fuel flow supplied to combustor 20. More specifically, as described above, the pilot flame generates a hot gaseous flow that suppresses combustion instability. As a result, in the exemplary embodiment, pilot swirler 100 facilitates reducing the combustion instabilities and further facilitates limiting emissions of NOx and CO.

In the exemplary embodiment a combustor includes two co-axial swirlers, a pilot swirler and a main swirler with an annular centerbody extending between the pilot and main swirlers. The pilot swirler is sized to receive about 5% of a total airflow entering the combustor. Moreover, the pilot swirler is configured to discharge about 0% to about 5% of a total fuel flow to the burner. The pilot swirler, in the exemplary embodiment, facilitates suppressing combustion instabilities occurring within the combustor. Moreover, in the exemplary embodiment, the pilot swirler facilitates limiting emissions of NOx and CO. As a result, pilot swirler 100, maintains low emission levels of NOx and CO while increasing the life of combustor components.

Exemplary embodiments of combustor pilot swirlers are described in detail above. The pilot swirler is not limited to use with the combustor described herein, but rather, the pilot swirler can be utilized independently and separately from other combustor components described herein. Moreover, the invention is not limited to the embodiments of the combustor pilot swirlers described above in detail. Rather, other variations of the combustor pilot swirlers may be utilized within the spirit and scope of the claims.

While the invention has been described in terms of various specific embodiments, those skilled in the art will recognize that the invention can be practiced with modification within the spirit and scope of the claims.

What is claimed is:

1. A combustor for use in a gas turbine engine comprising:

at least one burner;

at least one main swirler coupled to said at least one burner; and a pilot swirler coupled to said at least one main swirler, said pilot swirler comprising a hollow pilot centerbody, an inner swirler, an outer swirler, and an annular splitter extending between said inner and outer swirlers such that a pilot combustion zone is defined within said annular splitter, said hollow pilot centerbody comprising a plurality of apertures extending therethrough, said pilot swirler operable with only between about 0% and about 8% of the total airflow entering said combustor.

2. A combustor in accordance with claim 1 wherein said pilot swirler is further operable with only about 5% of the total airflow entering said combustor.

3. A combustor in accordance with claim 1 wherein said pilot swirler is configured to inject between about 0% and about 5% of the total fuel flow supplied to said combustor into said pilot combustion zone through said plurality of apertures.

4. A combustor in accordance with claim 1 wherein said pilot swirler is configured to inject about 2% of the total fuel flow supplied to said combustor into said pilot combustion zone through said plurality of apertures.

5. A combustor in accordance with claim 1 wherein said pilot swirler facilitates reducing combustion instabilities generated by said combustor.

6. A combustor in accordance with claim 1 wherein said pilot swirler facilitates limiting a generation of NOx and CO emissions by said combustor.

7. A gas turbine engine comprising a combustor coupled in flow communication with a compressor, said combustor comprising a main swirler and a pilot swirler coupled to said main swirler, said pilot swirler comprising a hollow pilot centerbody, an inner swirler, an outer swirler, and an annular splitter extending between said inner and outer swirlers such that a pilot combustion zone is defined within said annular splitter, said hollow pilot centerbody comprising a plurality of apertures extending therethrough, said pilot swirler operable with only between about 0% and about 8% of the total airflow entering said combustor.

8. A gas turbine engine in accordance with claim 7 wherein said pilot swirler is configured to inject between about 0% and 5% of the total fuel flow supplied to said combustor into said pilot combustion zone through said plurality of apertures.

9. A gas turbine engine in accordance with claim 7 wherein said pilot swirler is configured to inject about 2% of the total fuel flow supplied to said combustor into said pilot combustion zone through said plurality of apertures.

10. A gas turbine engine in accordance with claim 7 wherein said pilot swirler facilitates reducing combustion instabilities generated by said combustor.

11. A gas turbine engine in accordance with claim 7 wherein said pilot swirler facilitates limiting a generation of NOx and CO emissions by said combustor.

12. A gas turbine engine in accordance with claim 7 wherein said pilot swirler is further operable with only about 5% of the total airflow entering said combustor.

* * * * *